United States Patent [19]

Harris

[11] Patent Number: 4,669,585

[45] Date of Patent: Jun. 2, 1987

[54] SLIDING GATE ASSEMBLY FOR AN EXHAUST BRAKE

[75] Inventor: Victor A. Harris, London, England

[73] Assignee: Hersham Valves Ltd., Walton on Thames, England

[21] Appl. No.: 770,391

[22] Filed: Aug. 28, 1985

[30] Foreign Application Priority Data

Jun. 7, 1985 [GB] United Kingdom ..... 8514447

[51] Int. Cl.[4] ..... F02D 9/06

[52] U.S. Cl. ..... 188/273; 60/324; 123/323; 137/599.2; 251/326

[58] Field of Search ..... 188/273; 137/599.2; 123/323; 60/324; 251/326

[56] References Cited

U.S. PATENT DOCUMENTS

| | | | |
|---|---|---|---|
| 2,190,412 | 2/1940 | McMurry | 137/599.2 |
| 2,745,517 | 5/1956 | Zook | 188/319 |
| 4,054,156 | 10/1977 | Benson | 123/323 X |
| 4,060,453 | 11/1977 | Schabert et al. | 137/599.2 X |
| 4,205,704 | 6/1980 | Benson | 188/273 X |
| 4,408,627 | 10/1983 | Harris | 188/273 X |
| 4,509,549 | 4/1985 | Cooper et al. | 137/599.2 X |

FOREIGN PATENT DOCUMENTS

| | | | |
|---|---|---|---|
| 1153208 | 8/1963 | Fed. Rep. of Germany | 123/323 |
| 29906 | of 1913 | United Kingdom | 188/319 |
| 822078 | 10/1959 | United Kingdom | 188/273 |

*Primary Examiner*—George E. A. Halvosa
*Attorney, Agent, or Firm*—Ladas & Parry

[57] ABSTRACT

A slidable gate assembly is to be mounted on an exhaust brake having a housing with aligned inlet and outlet apertures to allow the passage of exhaust gas through the housing. The flow of exhaust gas is controlled by a slidable valve gate forming part of the slidable gate assembly and having an exhaust gas relief passage therethrough. The valve gate is mounted on one end of the piston rod and at that same end there is provided a closure device for opening and closing the exhaust gas relief passage in the valve gate. A biasing force applied through the piston rod, preferably by a coil spring, biases the closure device towards a closed condition of the exhaust gas relief passage. The piston rod is movable relative to the valve gate to open the exhaust gas relief passage through the valve gate in dependance upon the force applied by the biasing spring. The closure device is forced to an open condition by the pressure of exhaust gas applied through the exhaust gas relief passage to the closure device. With this construction the biasing spring can be located at a position remote from the body of the exhaust brake so as to be operable below the setting temperature of the spring.

7 Claims, 5 Drawing Figures

SLIDING GATE ASSEMBLY FOR AN EXHAUST BRAKE

Figure 1:
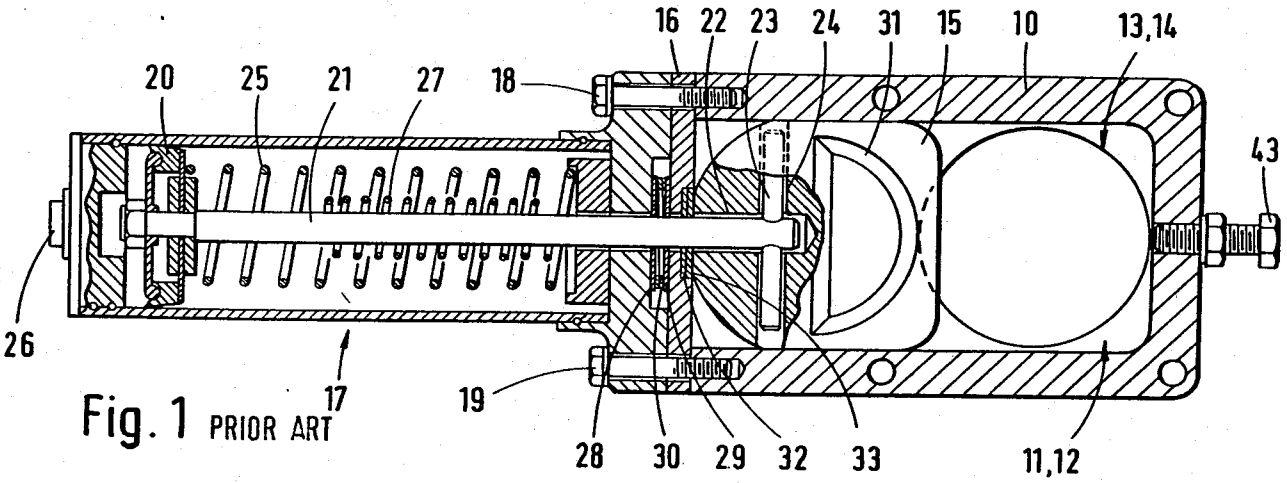
Fig. 1 PRIOR ART

This invention relates to a sliding gate assembly for an exhaust brake.

Exhaust brakes are known to be adapted to be specifically located in the exhaust system of an internal combustion engine so that upon closure of a valve gate back pressure to the engine is created, thus providing or enhancing engine braking when the engine is used for propelling a road vehicle. Exhaust brakes are generally located in front of the muffler box of an exhaust system, relative to the flow of air through the exhaust system, as close to the outlet manifold of the internal combustion engine as possible, and often mounted directly onto the turbo charger.

Control of the brake pressure in the exhaust manifold following operation of an exhaust brake is necessary since some engine manufacturers claim that if the valve gate of the exhaust brake was simply used to shut off the exhaust passage excessive pressure will build up in the exhaust manifold and lift the engine exhaust valves which may then come into contact with a piston moving in its cylinder to Top Dead Centre.

To avoid excessive damage to the engine in this way, some attempt has been made to control this problem by ensuring that a particular bypass opening is provided even when the valve gate is considered for all other purposes to have closed the exhaust gas passage through the exhaust brake. One particular method disclosed in British Pat. No. 1501631 is to provide a stop mounted on the body of the exhaust brake so that the valve gate is prevented from completely closing the exhaust passage through the exhaust brake.

Another solution to this particular problem has been to provide a hole through the valve gate of a particular diameter which will ensure the back pressure in the exhaust manifold cannot increase beyond a particular level, which is determined by the engine manufacturer.

An engine manufacturer when setting the top limit for manifold pressure does so at the highest rated engine speed. Consequently, a hole drilled in the exhaust brake slide must be of a size to allow the high volumes of exhaust gases to pass through at high engine revolutions. However, at lower engine speeds the presence of the hole means that it is not possible to maintain the maximum allowable pressure. For example, the Cummins L10 engine has an allowable pressure of 65 PSI (4.78 kg/cm$^2$) at maximum engine revolutions, which is obtained by drilling a 15.25 mm hole through the exhaust brake slide. Therefore at 1500 rpm the back pressure is 32 lbs (2.25 kg/cm$^2$). Since the amount of retardation obtained by the exhaust brake is governed by manifold pressure retardation drops accordingly.

Several attempts have been made to overcome this problem by controlling the gas flow through the bypass but it has been shown that simple relief valves using springs do not work in the exhaust system owing to the high operating temperatures, 1400° F. (760° C.) having been recorded on the turbo face, corrosive gases and build-up of carbon which renders these devices inoperative. More particularly, the temperatures applied to the exhaust brake are so great as to surpass the setting temperature of the springs used in the simple relief valves thus rendering such valves totally unusable.

Another method of overcoming this problem has been to sense manifold pressure through a pressure valve and either to bleed off the air to a hydraulic cylinder controlling the gate, or in the case of the double acting cylinder, introduce air into the cylinder in front of the operative piston as well, thus taking off the exhaust brake. Because of the high temperatures and carbon built-up this method has not been successful.

It is therefore desirable to provide a slidable gate assembly for an exhaust brake in which the above disadvantages are substantially overcome.

According to the present invention there is provided a slidable gate assembly for an exhaust brake having a housing with aligned inlet and outlet apertures which allow the passage of exhaust gas through the housing, the slidable gate assembly comprising a valve gate being arranged to be slidable in the housing for controlling the flow of the exhaust gas through the inlet and outlet apertures and having an exhaust gas relief passage therethrough, a piston rod connected with the valve gate for moving the valve gate, closure means mounted on the piston rod for opening and closing the exhaust gas relief passage in the valve gate, and biasing means for biasing the closure member towards a closed condition of the exhaust gas relief passage when the valve gate closes the exhaust gas passage through the exhaust brake, wherein the piston rod is movable relative to the valve gate to open the exhaust gas relief passage through the valve gate in dependence upon the force applied by the biasing means.

In one preferred embodiment of a slidable gate assembly for and exhaust brake the closure member is slidable on the valve gate to close the exhaust gas relief passage therethrough. The closure means is mounted in a recess in one face of the valve gate. A further recess is provided in the opposite face of the valve gate to that having the first mentioned recess, the exhaust gas relief passage being located in a common wall separating the first mentioned and further recesses. Preferably, the closure means comprises plate slidable in the first mentioned recess to close the exhaust gas passage. The plate is preferably freely movable on the piston rod, although, in an alternative embodiment the plate can be fixed to the end of the piston rod.

Conveniently, a seal housing is located at the end of the piston rod remote from that end at which the valve gate is mounted and an end plate fixed to the end of the piston rod having the seal housing such that the seal housing is located against the end plate between the end plate and the valve gate. It is preferred that the biasing means is a spring, such as a coil spring, which is mounted around the piston rod between a flange on the piston rod and a seal housing movably located on the piston rod at the end of the piston rod remote from the valve gate.

According to another aspect of the present invention there is provided an exhaust brake including a housing with aligned inlet and outlet apertures which allow the passage of exhaust gas through the housing, and a slidable gate assembly comprising a valve gate having an exhaust gas relief passage therethrough and being arranged to be slidable in the housing for controlling the flow of exhaust gas throught the inlet and outlet apertures, a piston rod connected with the valve gate for moving the valve gate, closure means mounted on the piston rod for opening and closing the exhaust gas relief passage in the valve gate, and biasing means for biasing the closure member towards a closed condition of the exhaust gas relief passage when the valve gate closes the exhaust gas passage through the exhaust brake, wherein the piston rod is movable relative to the valve gate to open the exhaust gas relief passage through the valve gate in dependance upon the force applied by the biasing means.

In one particular embodiment the biasing means comprises a spring which in a closed position of the valve gate relative to the said apertures of the exhaust brake body, is effective to close the relief passage in the valve gate. Preferably, the spring is mounted at one end of the piston rod. Conveniently the closure means is mounted on the opposite end of the piston rod remote from that end at which the spring is mounted.

Figure 2:
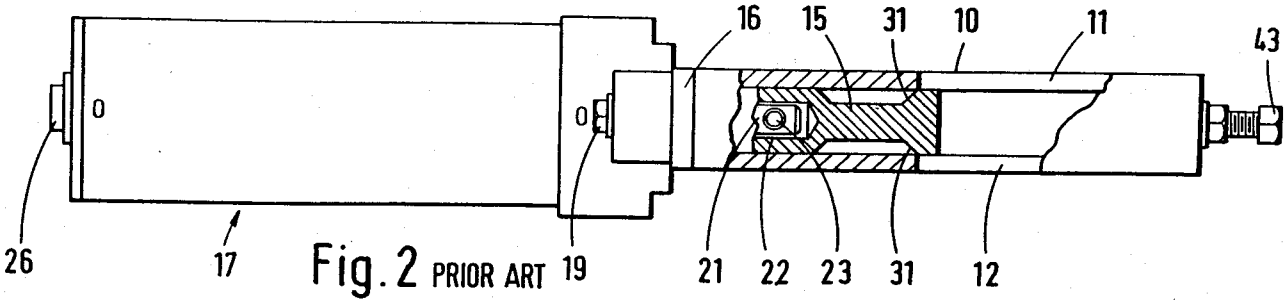
Fig. 2 PRIOR ART
Figure 3:
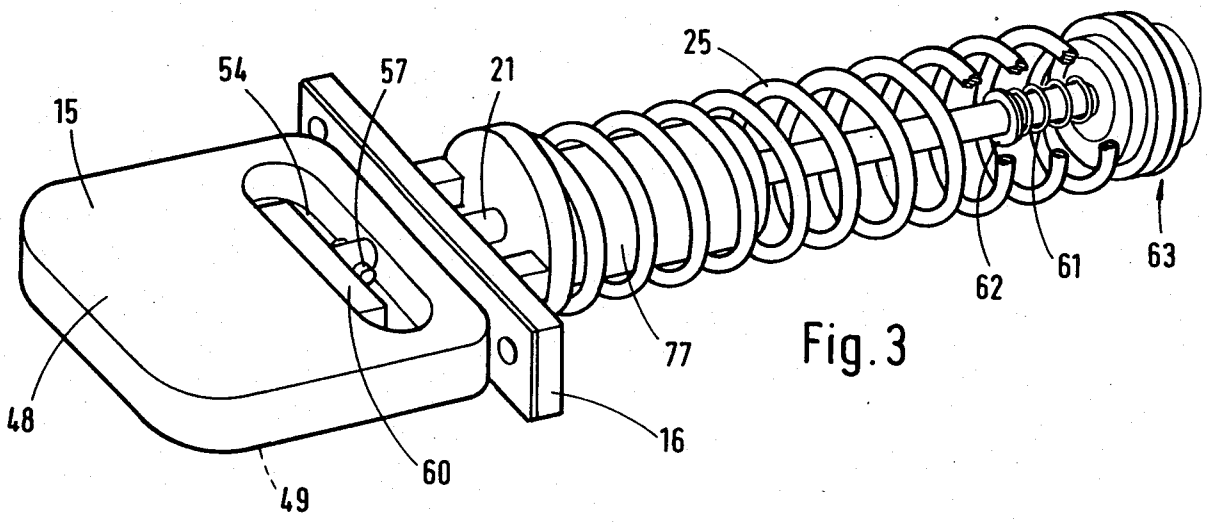
Figure 5:
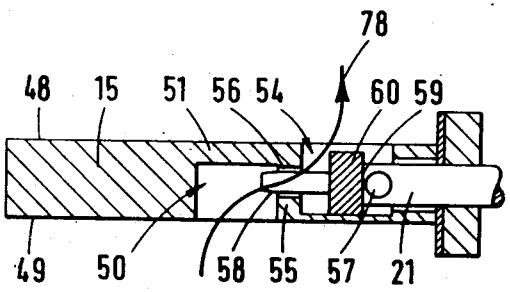
Figure 4:
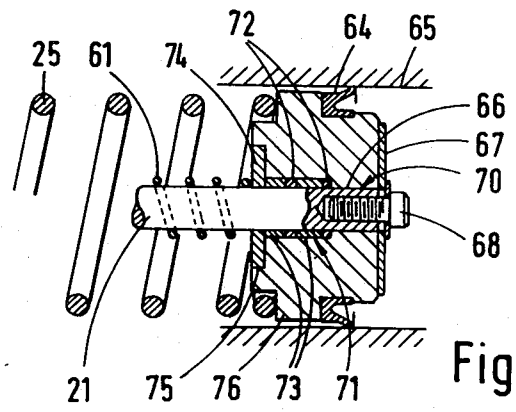

An embodiment of the present invention will now be described by way of example with reference to the accompanying drawings, in which;

FIG. 1 shows a schematic view of an exhaust brake taken across the line of exhaust flow through the exhaust brake, FIG. 2 show a schematic side elevation of the exhaust brake of FIG. 1, FIG. 3 illustrates a perspective view of a slidable gate assembly according the present invention, FIG. 4 is a part sectional view through the right hand end of the exhaust brake slider assembly of FIG. 3, and FIG. 5 is a part sectional view through the gate at the left hand end of FIG. 3.

FIGS. 1 and 2 show one known exhaust brake which is arranged for fitment in an exhaust manifold or pipe system of round cross-section.

The exhaust brake comprises a hollow body 10 having opposing walls 11 and 12 which define a valve chamber and apertures 13 and 14 in the walls 11 and 12 respectively, which define an exhaust passage through the chamber. A valve closure gate 15 is a loose sliding fit in the valve chamber and is capable of sealing engagement with either of the walls 11 and 12, and is movable between the postion shown in FIGS. 1 and 2 in which it is clear of the apertures 13 and 14 to leave the exhaust passage substantially unobstructed, and a position to the right (FIGS. 1 and 2) in which it closes the apertures 13 and 14 to close the exhaust passage.

The walls 11 and 12 are adapted to be fitted, by their outside surfaces, to suitable flange joints in the exhaust system.

The valve chamber of the hollow body 10 opens to an end face of the body which closed by a removable plate 16 which also forms an end stop for the movement of the valve gate 15 to its open position. A single acting fluid pressure operated piston and cylinder device, indicated generally at 17, is mounted by flange on the body 10 outside the plate 16. Bolts 18 and 19 which are screw threaded into the body 10 serve to locate and hold the device 17 and the plate 16 on the body 10. The fluid pressure device 17 is provided with a piston 20 and a piston rod 21 which last extends through the plate 16 into a bore 22 in the valve closure member 15. The valve gate 15 is attached to the piston rod 21 by means of a cross pin 23 which is securely fixed in the end of the piston rod 21, a cross bore 24 being provided in the valve gate 15 to receive it. Both the bores 22 and 24 are a generous clearance fit over the piston rod 21 and the pin 23 respectively, and allow the valve gate 15 to float on the piston rod 21 during motion of the gate between the open and closed positions thus to allow exhaust gas pressure to drive it into sealing engagement with the inside surface of the respective wall 11 and 12. The fluid pressure device 17 also includes a return spring 25 arranged around the piston rod 21 behind the piston 20 to bias the piston and consequently the valve gate 15 towards the open position.

Thus it can be seen that when fluid under pressure is supplied to the front face of the piston 20 through a port 26 the valve gate 15 will be driven to the right, to close the apertures 13 and 14, whereas when the pressure is released from the device 17, the valve gate 15 will be moved back to its open position by means of the spring 25.

An auxiliary return spring 27 which is shorter than the spring 25 is provided around the piston rod 21 inside the spring 25 to be engaged and compressed against the end of the cylinder by the piston 20 over only that part of its stroke where the valve gate approaches the closed position. Thus it can be seen that the spring 27 is only operative over the end of the stroke that closes the valve and provides additional spring force to overcome any initial resistance caused by any build up of carbon deposits on the valve at the beginning of an opening stroke.

Scraper rings 28 and 29, preferably made of nylon material, are positioned around the piston rod 21 between the plate 16 and the flanged body of the device 17, to remove any carbon deposits from the piston rod and prevent them from entering the device 17. A spring 30 is located between the scraper rings to keep them in position against the plate 16 and the flange of the device 17 respectively.

In the exhaust brake disclosed with reference to FIGS. 1 and 2 an adjustable abutment in the form of a set screw 43 is provided in the body to engage the valve gate 15 in its closed position affording some adjustment of that position. Accordingly, the valve gate 15 may completely shut off the exhaust gas passage, or the set screw 43 can be adjusted so that in the closed position of the valve gate 15 the exhaust passage is not completely shut off but allows a restricted amount of the exhaust gas to flow through the valve.

It can be seen that by removing the device 17 and the plate 16 from the body of the valve in each of the embodiments, the valve gate 15 may be extracted for surfacing without disturbing the mounting of the body 10 of the exhaust system.

Referring now to FIGS. 3 through 5 there is shown a slidable gate assembly and in these figures parts which are common with the exhaust brake of FIGS. 1 and 2 are given like reference numerals. For the sake of simplicity only those parts of the slidable gate assembly which differ from the corresponding assembly of FIGS. 1 and 2 will be described.

In the slidable gate assembly shown in FIGS. 3 through 5 valve gate 15 is provided with opposed planar surfaces 48,49. A recess 50 is provided in gate surface 49 and extends into the body of valve gate 15 leaving a relatively thin wall portion 51 separating the recess 50 from the opposite side of the valve gate. A recess 54 is also provided adjacent to recess 50, being separated by a side wall 55 and communicating one with the other by means of an elongate aperture 56 in the common recess wall 55. The recess 54 extends into the gate 15 from the opposite side surface to that from which recess 50 extends. Piston rod 21 extends into the recess 54 and is provided with a fixed cross-pin 57 which prevents removal of the piston rod relative to the valve gate 15.

A pressure plate 60 is located in the recess 54 and is engageable with wall 55 to completely close the aperture 52 therethrough. The plate 60 is mounted at one end of piston rod 21 for sliding movement within the recess 54 to allow opening and closing of the aperture 52. However, the plate 60 is loosely connected with the piston rod 21 so as to be movable in directions both axial and transverse relative to the longitudinal axis of the piston rod to ensure free movement of the plate 60 relative to the piston rod under high temperature and carbon coated conditions. More particularly the end of the piston rod 21 on which the plate 60 is mounted, has an end portion 58 of reduced diameter which extends through a corresponding aperture in plate 60 and aperture 56. As shown in FIG. 5 the plate 60 abuts a shoulder 59 defined by the change in diameter between end portion 58 and the remainder of the piston rod.

The position of the plate 60 relative to the aperture 52 is dependent upon both springs 25 and 61. Spring 25 is the main spring which directly effects movement of the gate 15 from the exhaust aperture 13,14 of the body 10 as shown with reference to the exhaust brake of FIGS. 1 and 2. Spring 61 is mounted on the piston rod 21 towards the end of the rod remote from that connected with the gate 15. The spring 61 is retained between a radially outstanding flange 62, such as a washer held by a cir-clip, and a seal housing 63 which supports a hydraulic seal 64 in contact with the inner surface of a cylindrical housing 65 mounted on plate 16, partially shown in FIG. 4. At this position in the construction of the exhaust brake according to the invention the spring 61 has been found to be subject to a maximum temperature of 107° C., well below the setting temperature of the spring.

The seal housing 63 has a bore 66 therethrough which the piston rod 21 extends to an end plate 67 which is fixed by bolt 68 to the end of the piston rod but is movable relative to the seal housing.

The bore 66 has three regions of differing internal diameters. The first region 70 has a diameter substantially identical to the outside diameter of the piston rod 21. The second region 71 is of slightly enlarged diameter and sealing O-rings 72 with annular packing washers 73 are located in the space provided between the seal housing and the piston rod. A retaining washer 74 is located in the third region 75 for engaging with the spring 61. The spring 25 engages in an annular circumferenctial recess 76 of the seal housing.

In operation of the slidable gate assembly, hydraulic pressure is applied to the right hand side of the seal housing 63 of FIG. 4. As this pressure is applied, that is, when the exhaust brake is applied, the piston rod 21 moves to the left in the drawings initially forcing the bar 60 against wall 55 and closing the aperture 52 through the gate 15. The piston rod 21 continues to move to the left forcing the gate 15 across the exhaust gas passage through the exhaust brake body 10 to close the passage. Simultaneously, the spring 25 is compressed until the seal housing 63 engages a cylindrical spacer 77 of plastics material located around the piston rod 21 inside the spring 25. The cylindrical spacer 77 may alternatively be made of a metallic material such as aluminum or steel. The exhaust passage through the exhaust brake is closed at the point when the seal housing 63 engages the spacer 77.

In this position exhaust gases from the exhaust manifold of an internal combustion engine are arranged to impinge on the face of the gate 15 in which the recess 50 is provided, as indicated by arrow 78. The exhaust gas is applied to the plate 60 through the aperture 52 in wall 55. When the pressure of the exhaust gas is sufficient the plate 60 and piston rod 21 are forced to the right in the drawings, against the force of the spring 61. As the piston rod 21 moves to the right the seal housing 63 and spring 25 are held in position by the hydraulic pressure applied to the seal housing. However, the piston rod 21 moves through the seal housing 63 and forces the end plate 67 off the seal housing body.

As the plate 60 moves away to open the aperture 52 the exhaust gases are vented through this aperture, as indicated by arrow 78, to the exhaust outlet pipe of a vehicle to which the exhaust brake is connected.

As the pressure of exhaust gases drops following venting through aperture 52 and recesses 52 and 54, the spring 61 takes over and forces the plate 60 towards wall 55, again closing aperture 52 until the exhaust gas pressure is sufficient to overcome the force of the spring 61 to lift the plate 60 and vent the exhaust gases. In reality, during this closed condition of the exhaust brake in which the flow rate of exhaust gases is high, the exhaust gases are substantially continuously applied to the face of the gate 15 and a balance position is reached where the pressure of the exhaust gases equalises with the pressure of the spring 61 with the bar 60 spaced from the aperture 52. This spacing varies slightly in accordance with engine revolutions as a relative steady pressure is maintained.

Therefore, it can be seen that the manifold pressure is dependent upon the compression force of the spring 61 which being located in a position remote from the gate 15 is subject to temperatures which are well below the setting temperatures of the spring 61, even when the gate 15 is subjected to its highest operating temperature.

With the slidable gate assembly of the present invention it can be seen that the exhaust manifold pressure varies in dependence upon the pressure applied by the spring 61 and vastly increased manifold pressures, 58 to 68 psi (399.91 to 468.86 k Pa) have been obtainable for one particular engine over the full engine revolution range, as shown in the following table:

| Engine Revolutions | Manifold Pressure | |
|---|---|---|
| RPM | PSI | (kg/cm$^2$) |
| 600 | 68 | (4.79) |
| 750 | 68 | (4.79) |
| 1000 | 68 | (4.79) |
| 1250 | 68 | (4.79) |
| 1500 | 65 | (4.57) |
| 1750 | 65 | (4.57) |
| 2000 | 65 | (4.57) |
| 2300 | 58 | (4.007) |

In one alternative construction of the gate valve 15 the side wall of the recess 50 opposite to wall 55 is sloped at an angle of 45° to assist in directing the exhaust gas flow towards the aperture 52 in the wall 55.

In yet another construction the pressure plate 60 is fixed to the end of the shaft 21 at a position suitable for opening and closing aperture 52, such as in the position shown in FIG. 5.

I claim:

1. A slidable gate assembly for an exhaust brake having a housing with aligned inlet and outlet apertures which allow the passage of exhaust gas through the housing, the slidable gate assembly comprising a valve gate having an exhaust gas relief passage therethrough for allowing continual flow of exhaust gases therethrough for maintaining a predeterminded exhaust gas back pressure in an engine when the valve gate closes the exhaust gas passage through the exhaust brake housing, the valve gate being arranged to be slidable in the housing for controlling the flow of the exhaust gas through the inlet and outlet apertures of the said housing, a piston rod coupled at one end thereof with the valve gate for moving the valve gate, closure means mounted on the piston rod at the said one end thereof for controlling the size of aperture of the exhaust gas relief passage in the valve gate, a seal housing located at the end of the piston rod remote from that end on which the valve gate is mounted, the seal housing constituting a piston of a piston and cylinder fluid pressure device for moving the valve gate, the piston rod being movable in the seal housing, and baising means mounted on the piston rod at the end thereof remote from that end at which the closure means is mounted for biasing the closure means towards the closed condition of the exhaust gas relief passage when the valve gate closes the exhaust gas passage through the exhaust brake, wherein with the exhaust passage closed by the valve gate the piston rod and closure means are continually movable relative to the valve gate to control the continuous flow of exhaust gas through the exhaust gas relief passage in dependence upon the force supplied by the biasing means.

2. An assembly according to claim 1, wherein the closure means is slidable on the valve gate to close the exhaust gas relief passage therethrough.

3. An assembly according to claim 1, wherein the closure means is mounted in a recess in one face of the valve gate.

4. An assembly according to claim 3, including a further recess in the opposite face of the valve gate to that having the first mentioned recess, the exhaust gas relief passage being located in a common wall separating the first metioned and further recesses.

5. An assembly according to claim 4, wherein the closure means comprises a plate slidable in the first mentioned recess to close the exhaust gas relief passage.

6. An assembly according to claim 5, wherein the plate is freely movable on the piston rod.

7. An exhaust brake as claimed in claim 1, said piston and cylinder fluid pressure device being mounted on the exhaust brake housing for operating the valve gate between open and closed conditions of the exhaust passage through the exhaust brake.

* * * * *